United States Patent [19]

Ueda et al.

[11] 4,232,433

[45] Nov. 11, 1980

[54] SEAT BELT BUCKLE DEVICE

[75] Inventors: Takeo Ueda; Shinichi Fujita; Hideo Tachiki, all of Fujisawa; Shuichi Asano, Maebashi, all of Japan

[73] Assignee: NSK-Warner K. K., Tokyo, Japan

[21] Appl. No.: 24,377

[22] Filed: Mar. 27, 1979

Related U.S. Application Data

[62] Division of Ser. No. 811,386, Jun. 29, 1977.

[51] Int. Cl.[2] ..... A44G 11/26

[52] U.S. Cl. ..... 24/230 A

[58] Field of Search ..... 24/230 A

[56] References Cited

U.S. PATENT DOCUMENTS

| | | | |
|---|---|---|---|
| 3,364,531 | 1/1968 | Moss | 24/230 A |
| 3,533,141 | 10/1970 | Unai | 24/230 A |
| 3,623,191 | 11/1971 | Mayashi | 24/230 A |
| 3,790,994 | 2/1974 | Jakob | 24/230 A |
| 3,963,090 | 6/1976 | Mollins | 24/230 A |

FOREIGN PATENT DOCUMENTS

| | | | |
|---|---|---|---|
| 2404342 | 7/1975 | Fed. Rep. of Germany | 24/230 A |
| 1532589 | 6/1968 | France | 24/230 A |
| 2265295 | 11/1975 | France | 24/230 A |

*Primary Examiner*—Roy D. Frazier
*Assistant Examiner*—Alexander Grosz
*Attorney, Agent, or Firm*—Shapiro and Shapiro

[57] ABSTRACT

A seat belt buckle device having a latch device comprising a base, a latch member pivotally supported on the base and having a latching portion for locking a tongue, the latch member being biased into a tongue locking position, a push button adapted, when operated, to bring the latch member into an unlocking position, and a cover having an inlet port for inserting the tongue therethrough and an opening for operating the push button therethrough. The latch member is pivotally supported on a supporting bed secured to the base. The latch device further comprises means for holding the latch member in its unlocking position when the latch member is brought from its tongue locking position to its unlocking position by the push button, whereby the latch member is held in the unlocking position until the latch member is brought back to its tongue locking position after the tongue is again inserted in the inlet port.

10 Claims, 11 Drawing Figures

SEAT BELT BUCKLE DEVICE

This is a division of application Ser. No. 811,386, filed June 29, 1977.

BACKGROUND OF THE INVENTION

1. Field of the Invention

This invention relates to a buckle device for the seat belt in a vehicle.

2. Description of the Prior Art

Various types of such buckle device are known. A typical one basically comprises a push button, a latch device having a latch member pivotable by bias means operable by the push button, and a tongue adapted to be inserted into the latch device and locked by the latch member. However, the buckle devices of the prior art have offered various disadvantages in safety and ease of handling, as will hereinafter be described more specifically.

(1) It is empirically known that if the tongue inserted into and locked by the latch device is pulled with a force of approximately 2.4 tons, the tongue will be deformed and slip out. This is considered to be attributable to the fact that the great degree of inclination of the upwardly biased latch member resting on the base of the latch device tends to create a couple of forces which deforms the tongue. Such a degree of pull force may occur, for example, from a great impact exerted on a vehicle occupant when an automobile running at high speed collides against another, and this may cause the tongue to slip out to invite a danger of serious disaster. To avoid such danger, the tongue must be made bulky and this would in turn lead to a larger size of the entire buckle device.

(2) When the tongue is inserted into the latch device so as to be locked by the latch member, and when the tongue is withdrawn from the latch device by operating the push button to unlock the tongue from the latch member, the latch member biased upwardly by bias means tends to cause occurrence of the so-called false latching condition in which the tongue is pinched between the latch member and a part of the base of the latch device and becomes hardly movable. This would make the wearer of the seat belt feel worried about manipulation of the buckle device, and may lead him to believe that the tongue is completely locked by the latch member, in spite of the fact that the tongue is not completely latched. Accordingly, for example, during an emergency in which great shocks are exerted on the belt wearer, the tongue would simply slip out of the latch device, with a result that the buckle device could not achieve its intended purpose.

SUMMARY OF THE INVENTION

It is therefore a first object of the present invention to provide a buckle device which ensures a high degree of safety.

It is a second object of the present invention to provide a buckle device which is easier to handle.

It is a third object of the present invention to provide a buckle device which ensures higher intensity of engagement between the tongue and the latch device and which is more compact in size.

It is a fourth object of the present invention to provide a buckle device in which occurrence of false latching condition may be prevented and the tongue can easily be brought into and out of the latch device and positively locked by the latch device.

According to the present invention, the buckle device comprises, in addition to those elements constituting the above-described typical buckle device, a supporting bed secured to the base for pivotally supporting the latch member on the base, and further comprises false latching preventing means movable to a first position to maintain the latch member in its unlocking position as soon as the latch member is released from its tongue locking position by the push button, and movable from said first position to a second position to liberate the latch member from its unlocking position in response to the insertion of the tongue.

The invention will become more fully apparent from the following detailed description of some preferred embodiments thereof taken in conjunction with the accompanying drawings.

DESCRIPTION OF THE PREFERRED EMBODIMENT

Figure 1:
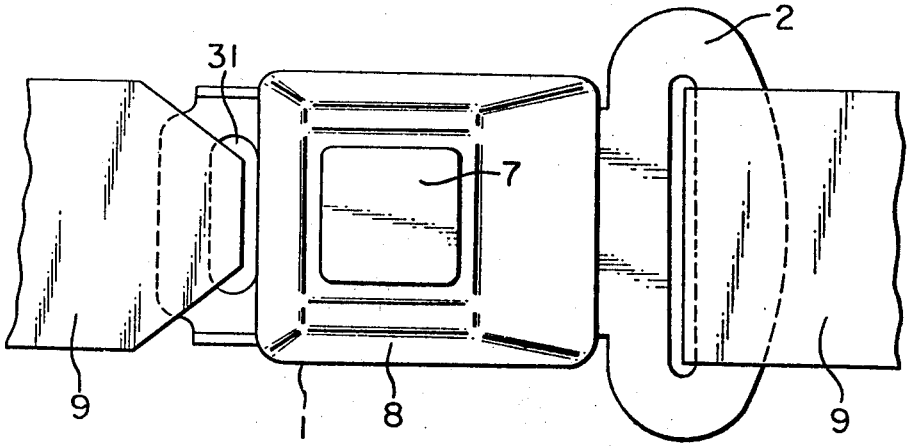
FIG. 1 is a plan view showing the manner of engagement between the latch device according to a first embodiment of the present invention and the tongue.
Figure 4:
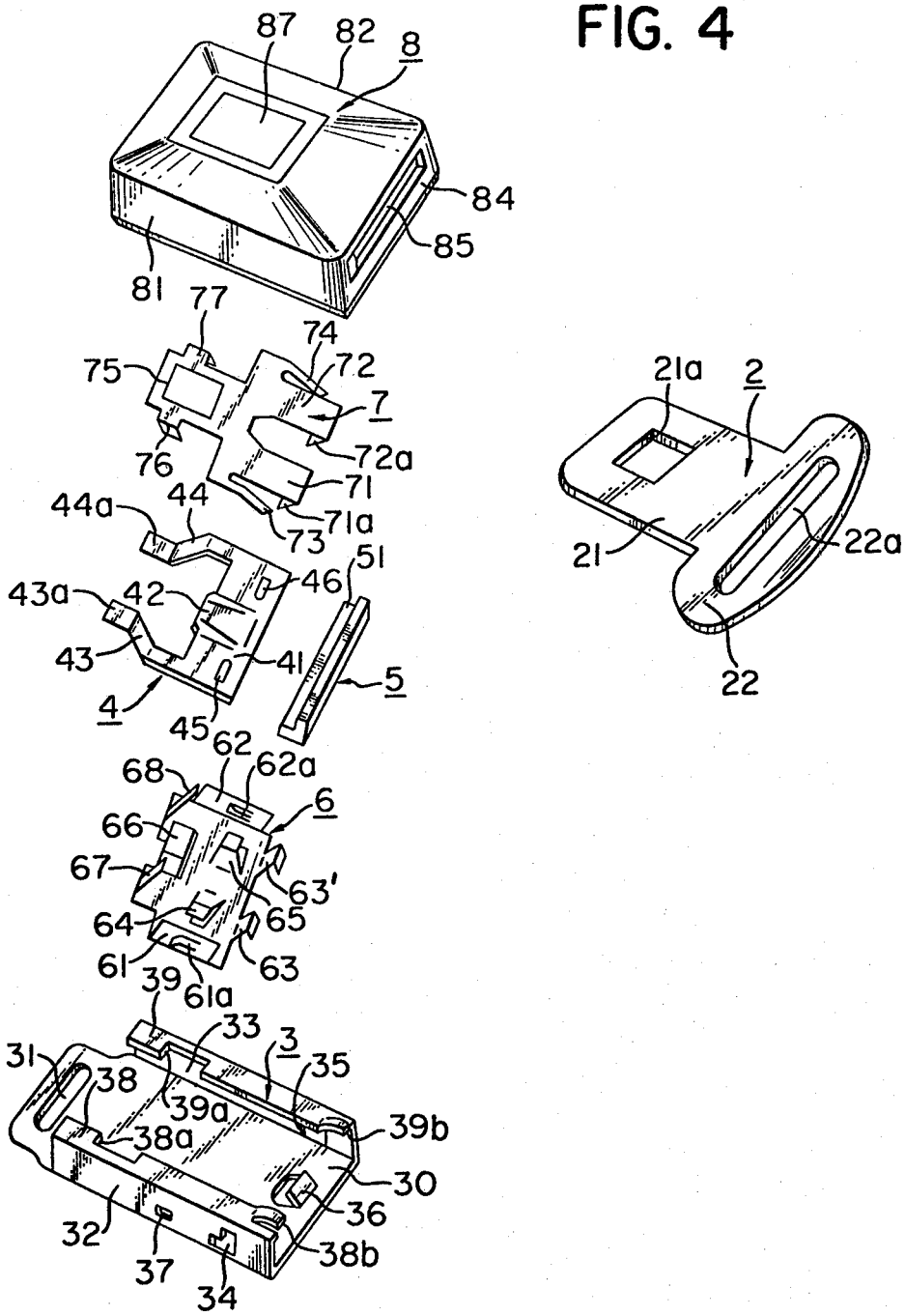
FIG. 4 is an exploded view of the same embodiment.

Referring to FIG. 1, it is a plan view showing a buckle device in a position wherein a tongue 2 is locked by a latch device 1. As shown in an exploded view of FIG. 4, the latch device 1 comprises a base 3, a latch member 4, a latch member supporting bed 5, spring means 6 for biasing the latch member 4 into its locking position, a push button 7 and a cover 8 for all these parts.

The base 3 has a substantially rectangular central bottom plate portion 30 having a slot 31 for the connection of webbing 9 (FIG. 1) formed adjacent to one lengthwise end thereof. The base 3 is also formed with side walls 32 and 33 extending lengthwise of the central bottom plate 30 along the opposite side edges thereof and rising substantially at right angles with respect to the bottom plate. Stepped holes 34 and 35 are formed in opposed relationship through the side walls 32 and 33 in the end portions thereof which are lengthwisely opposite from the slot 31. The stepped holes 34 and 35 are similar in shape to the cross-sectional shape of the latch member supporting bed 5 which will later be described, so that the opposite ends of the latch member supporting bed 5 are received and securely positioned in the stepped holes. The central bottom plate 30 is also formed with an upwardly extending projection 36 engageable with the vicinity of the center of the latch member supporting bed 5 to prevent this bed 5 from being deformed in a direction in which the tongue is withdrawn. Holes for positioning the spring means 6 which will later be described are formed in opposed relationship through the base side walls 32 and 33 in the vicinity of the lengthwise center thereof, but only one of such holes is seen at 37 in FIG. 4. The upper ends of the base side walls 32 and 33 form inwardly bent portions 38 and 39. These bent portions are formed with opposed cut-aways 38*a* and 39*a* for guiding the push button 7. Protrusions 38*b* and 39*b* are formed on the ends of the bent portions 38 and 39 into which the tongue is to be inserted, and these protrusions function as positioning and fulcrum members for the push button, as will later be described.

As already noted, the latch member supporting bed 5 is inserted into the stepped holes 34 and 35 of the base side walls 32 and 33 and rests on the base bottom plate 30. The supporting bed 5 has a step 51 extending over the entire length thereof, and the end edge portion 41 of the latch member 4 rests on the step 51.

The latch member 4 has an upwardly extending projection 42 formed in the center thereof for locking the tongue, and also has horned portions 43 and 44 extending from the opposite edges thereof. The ends of the horned portions 43 and 44 are upwardly bent at 43*a* and 44*b* for engagement with ears 76 and 77 of the push button 7 which will later be described.

The spring means 6 is provided between the latch member 4 and the base bottom plate 30 and placed on the base bottom plate 30. The spring means 6 has side portions 61 and 62 extending along the opposite side edges thereof and upwardly bent at right angles, and spring pieces 61*a* and 62*a* outwardly projected from the side portions 61 and 62 are hooked in the positioning holes 37 of the base side walls. Upwardly extending spring pieces 63 and 63' are formed at the right end edge of the spring means 6, as viewed in FIG. 4, and these spring pieces are engaged in holes 45 and 46 formed in the latch member 4 so as to urge and position the latch member against the supporting bed 5. Additional spring pieces 64 and 65 which extend upwardly are formed in the center portion of the spring means 6 and engaged with the underside of the latch member 4 to upwardly bias the latch member into its locking position. The spring means is also formed with a bent piece 66 located below the end of the inserted tongue and engaged with that end to support the same from below so that the tongue may substantially contact the underside of the inwardly bent portions 38 and 39 of the base side walls 32 and 33 to prevent backlash thereof. At the left end portion of the spring means 6, as viewed in FIG. 4, there are formed third spring pieces 67 and 68 which are upwardly bent and when the tongue is inserted into the locking position, the third spring pieces 67 and 68 engage the end of the tongue to bias the tongue outwardly, namely, to bias the tongue so as to move it into its non-locked position when it is disengaged from the latch member.

The cover 8 attached to the base so as to cover all the foregoing members is substantially box-shaped, and has side walls 81 and 82 extending parallel to the base side walls 32 and 33, and end walls 83 and 84 extending substantially perpendicularly to said side walls 81 and 82 and across the base side walls. Of these end walls, the right end wall 84 is formed with a slot 85 for inserting the tongue therethrough. The lower edge of the tongue insertion slot 85 is formed with an inwardly extending projection 84*a* which reinforces the slot and on which the inserted tongue may rest. The upper wall of the cover 8, which is formed with a sloped surface 86, is formed with an opening 87 for operating the push button 7. Inwardly of and widthwisely centrally of the sloped surface 86, between the opening 87 and the slot 85, there is formed a lengthwisely and downwardly extending projection 88 for guiding and positioning the tongue and for reinforcing the cover, and the lower edge of this projection 88 extends substantially parallel to the lower edge of the inwardly bent portions 38 and 39 of the base 3.

The push button 7 is positioned in such a manner that the bent portions 71*a* and 72*a* provided on the ends of the legs 71 and 72 are engaged with the protrusions 38*b* and 39*b* formed on the opposite sides of the base 3, and the push button is pivotable about such position. The push button 7 is formed with downwardly extending spring pieces 73 and 74 which engage the upper surfaces of the inwardly bent portions 38 and 39 of the base side walls 32 and 33 to upwardly bias the push button itself. On the opposite sides of the flat head 75 of the push button 7, there are formed downwardly extending ears 76 and 77. These ears engage the horned portions 43*a* and 44*a* of the latch member 4, as already noted. Thus, the push button 7 has its flat head 75 normally brought into contact with the frame portion of the opening 87 by the bias forces of the latch member 4 and the push button itself. At the same time, the ears 76 and 77 of the push button 7 lie within the inner recess 89 of the cover 8. When the push button is depressed, the ears 76 and 77 are downwardly guided within the cut-aways 32 and 33 formed in the base side walls 32 and 33 to downwardly urge the latch member 4 by means of the horned portions 43*a* and 44*a* thereof.

The tongue 2 comprises a portion 21 adapted to be inserted into the latch device through the slot 85 of the buckle cover 8 and a portion 22 for connection to the webbing. The insertable portion 21 of the tongue 2 is formed with a locking hole 21*a* engageable with the projection 42 of the latch member 4 so as to prevent withdrawal of the tongue, and the webbing connection portion 22 of the tongue 2 is formed with a slot 22*a* for the connection of the webbing.

Figure 2:
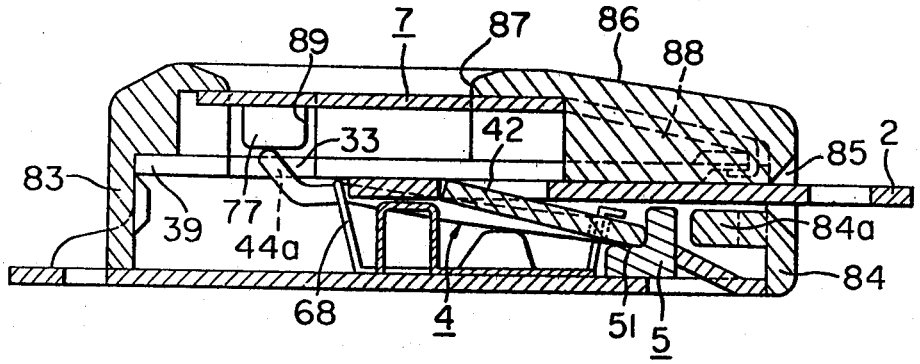
FIG. 2 is a longitudinal cross-section of the same embodiment taken along the center line thereof and showing the position in which the tongue is locked.
Figure 3:
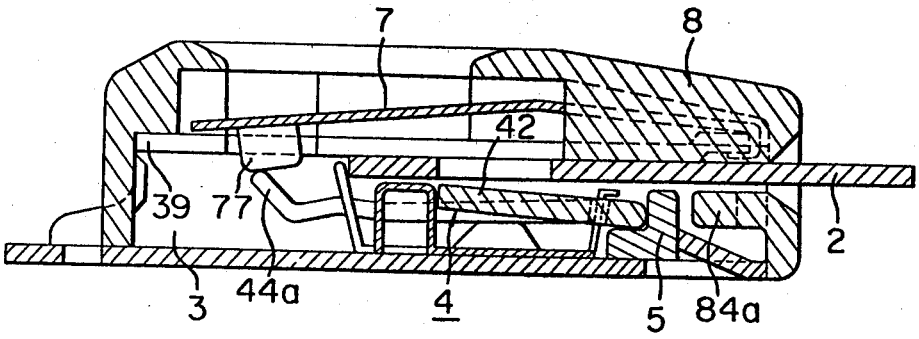
FIG. 3 is a view similar to FIG. 2 but showing the position in which the tongue is unlocked by operation of the push button.

With the above-described construction, the latch member 4 of the latch device 1 is upwardly biased into the position of FIG. 2 by the spring pieces 64 and 65 of the spring means 6.

Now, when the tongue 2 is inserted into the buckle device 1 through the slot 85, the inner end of the tongue 2 initially pivots the latch member 4 counter-clockwisely by means of its central projection 42 against the bias of the spring pieces 64 and 65, so that the tongue 2 is inserted into a predetermined position. When this occurs, the central projection 42 faces the locking hole 21*a* of the tongue 2, so that the latch member 4 is returned to its initial position by the action of the second spring pieces 64 and 65 and the central projection 42 comes into the locking hole 21*a* of the tongue, thereby locking the tongue. At the same time, the inner end of the tongue is engaged with the third spring pieces 67 and 68 of the spring means 6 to urge these spring pieces into their biasing positions.

When the push button 7 is depressed to detach the tongue, the push button is pivoted counter-clockwise to cause the ears 76 and 77 to downwardly urge the horned portions 43*a* and 44*a* of the latch member 4 against the action of the second spring pieces 64 and 65. Thus, the latch member 4 is pivoted counter-clockwise to release the lock of the central projection 42. Thus, by the third spring pieces 67 and 68, the tongue 2 is outwardly urged by the spring pieces 67 and 68, thus becoming detachable.

According to the first embodiment of the present invention, the supporting bed 5 is inserted in the vicinity of the pivot axis of the latch member to reduce the degree of inclination of the latch member, thus reducing couple of forces and preventing deformation of the tongue. This means that the tongue will never be deformed to slip out even for a high load exerted thereon during the time of collision.

According to the same embodiment of the present invention, there is also provided a buckle device in which the length of the latch member may be small and which is compact and high in strength.

Figure 5:
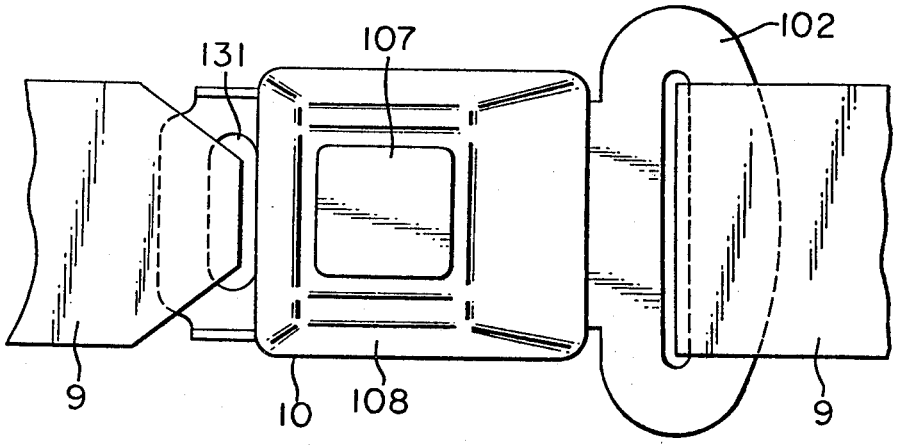
FIG. 5 is a plan view showing the manner of engagement between the buckle device according to a second embodiment of the present invention and the tongue.

The invention will now be described with respect to a second and a third preferred embodiment. FIG. 5 is a plan view showing a buckle device in a position in which a tongue 102 is locked by a latch device 10. As shown in the exploded view of FIG. 8 which illustrates the second embodiments of the present invention, the latch device 10 comprises a base 103, a latch member 104, a latch member supporting bed 105, a plate spring 106 for biasing the latch member toward its locking position, a push button 107, a slider 109 and two cylindrical spring 100, 110 as means for preventing false latching, and a cover 108 for covering all these parts.

The base 103 has a substantially rectangular, central bottom plate 130 having a slot 131 for the connection of webbing 9 (see FIG. 1) formed adjacent to one lengthwise end of the base. The base 103 has, on the opposite sides thereof which for the longer sides of the central bottom plate, side plates 132 and 133 bent substantially perpendicularly to the bottom plate. Stepped holes 134 and 135 are formed in opposed relationship in the side plates 132 and 133 adjacent to the ends thereof lengthwisely opposite from the slot. The stepped holes 134 and 135 are configured so as to receive the latch member supporting bed 105 and ears 141*a* and 141*b* extending from the horned portions of the latch member 104 and preferably, the stepped hole 134 may be relatively elongated in its upper portion so that the latch member 104 may be inserted into these holes of the base 103 through an end port adjacent to these holes. Thus, the latch member supporting bed 105 and the ears 141*a*, 141*b* of the latch member 104 are inserted into the stepped holes to thereby secure the latch member. The central bottom plate 130 is also formed with an upwardly extending projection 136 engageable with the latch member supporting bed 105 in the vicinity of the center thereof to prevent the supporting bed from being deformed in the tongue withdrawal direction. The upper ends of the base side plates 132 and 133 are continuous to inwardly bent portions 138 and 139. These bent portions are formed with opposed cut-aways 138*a* and 139*a* for guiding the push button 107. Cut-aways 138*b* and 139*b* are formed in the bent portions 138 and 139 at the tongue receiving ends thereof, and they function as positioning and fulcrum means for the push button 107, as will later be described. Further, cut-aways 138*a*, 139*a* and cut-aways 137 (only one of which is seen in FIG. 8) are formed in the base side plates 132, 133 at the ends thereof adjacent to the upwardly extending projections 136 and at the ends adjacent to the slot 131, respectively, so that when the cover 108 is inserted over the base these cut-aways are engageable with projections (not shown) provided on corresponding portions of the cover to positively secure the cover 108 to the base 103.

The latch member 104 has an upwardly extending projection 142 formed at the center thereof for locking the tongue, and horned portions 143 and 144 are projected from the left corners of the latch member, the ends 143*b*, 144*b* of the horned portions being slightly upwardly bent. The ends 143*b* and 144*b* are engaged with ears 176 and 177 of the push button 107 by means of grooves 143*a* and 144*a* suitably provided in said ends 143*b* and 144*b*.

A plate spring 106 is provided between the latch member 104 and the base bottom plate 130 and rests on the base bottom plate 130. Upwardly extending spring pieces 161*a* and 161*b* are formed on the opposite side edges of the plate spring 106 and respectively engaged with cut-aways 145 and 146, provided on the opposite sides of the latch member 104, to thereby position the latch member on the step 151 of the supporting bed 105. The plate spring 106 is formed with a bent portion 162 lying below the inner end of the inserted tongue 102 and engaged therewith to bring the tongue 102 substantially into contact with the underside of the inwardly bent portions 138 and 139 of the base side plates to prevent occurrence of backlash. At the left end of the plate spring 106, there is formed a second spring piece 163 which is upwardly bent, and when the tongue is inserted into the locked position, the second spring piece 163 engages the end of the tongue to bias the tongue outwardly, namely, to bias the tongue so as to move in its withdrawal direction when it is disengaged from the latch member (see FIG. 6).

Figure 8:
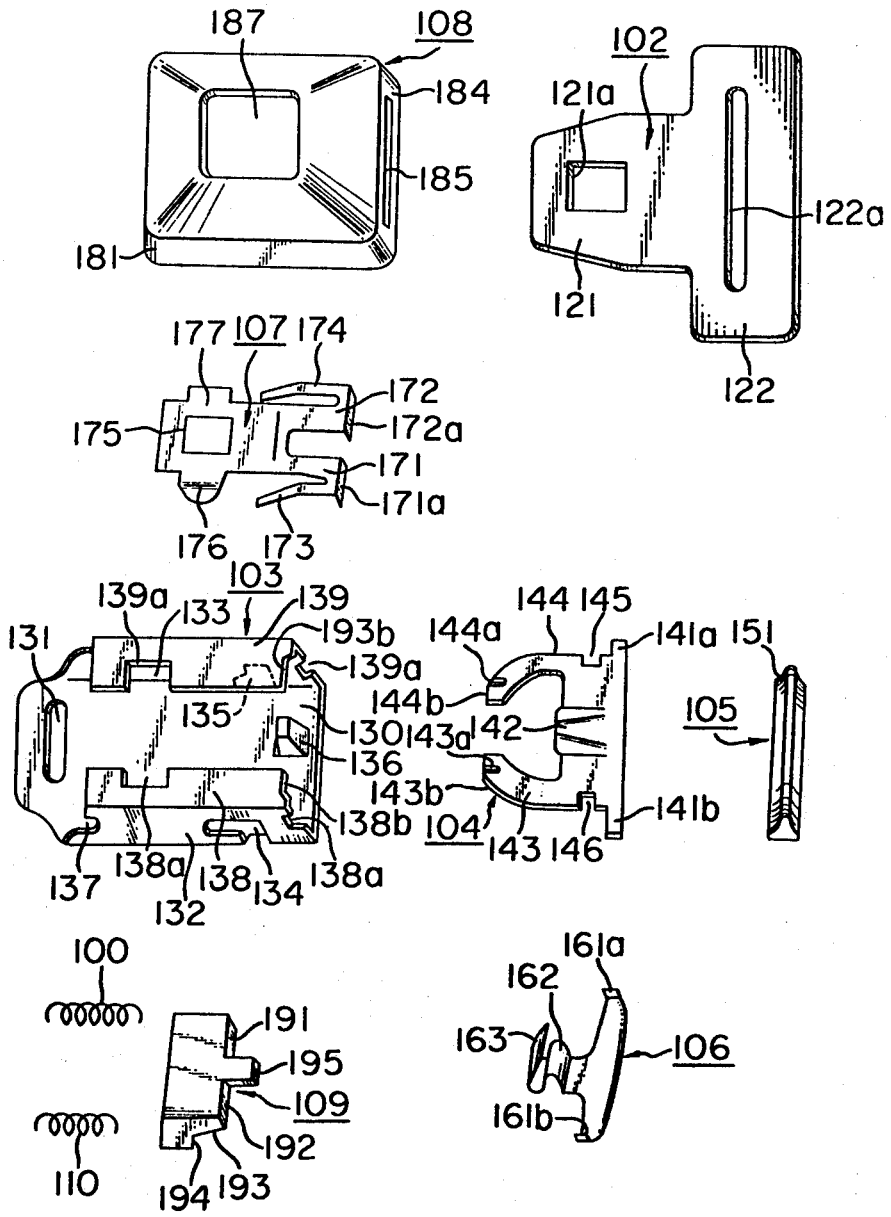
FIG. 8 is an exploded view of the same embodiment.

The cover 108, attached to the base so as to cover all of the foregoing parts and slider 109 and cylindrical coil springs 100, 110, is substantially box-shaped, and has side walls 181 (only one of which is seen in FIG. 8) extending parallel to the base side walls 132 and 133 and end walls 184 (only one of which is seen in FIG. 8) extending substantially perpendicularly to said side walls 181 and across the base side walls. Of these side with walls, the right side walls 184 seen in FIG. 8 is formed with a slot 185 for inserting the tongue therethrough. The lower edge of the tongue insertion slot 185 is formed with an inwardly extending projection 184*a* (see FIG. 6) which reinforces the slot and on which the inserted tongue may rest. The upper wall of the cover 108, which is formed with a sloped surface 186 (see FIG. 6), is formed with an opening 187 for operating the push button 107. Inwardly of and widthwisely centrally of the sloped surface 186, between the opening 187 and the slot 185, there is formed a lengthwisely and downwardly extending projection 188 (FIG. 6) for guiding and positioning the tongue and for reinforcing the cover, and the lower edge of this projection 188 extends substantially parallel to the lower edge of the inwardly bent portions 138 and 139 of the base.

The push button 107 is positioned in its operative position by the downwardly bent portions 171*a* and 172*a* provided on the ends of the legs 171 and 172 thereof being engaged with the cut-aways 138*b* and 139*b* formed on the ends of the inwardly bent portions 138 and 139 of the base, and the push button is pivotable about said positioning bent portions 171*a* and 172*a* by outer spring pieces 173 and 174 slightly downwardly extending along the outer sides of the legs 171 and 172 and engaging the upper surfaces of the inwardly bent portions 138 and 139 of the base side walls to upwardly bias the push button itself. Also, as already noted, the downwardly extending ears 176 and 177 are formed on the opposite side edge of the flat head 175 of the push button 107. These ears are operatively in contact with grooves 143*a* and 144*a* in the horned ends 143*b* and 144*b* of the latch member. Thus, the push button 107 has its flat head 175 normally brought into contact with the frame portion of the opening 187 by the bias forces of the latch member 104 and the push button itself. At the same time, the ears 176 and 177 of the push botton 107 lie within the inner recess 189 of the cover 108. When the push button is depressed, the ears 176 and 177 are inwardly guided within the cut-aways 138*a* and 139*a* formed in the inwardly bent portions of the base side walls to downwardly urge the latch member 104 while being engaged in the groove 143*a* and 144*a* in the horned portions of the latch member 104 extending along the outer sides of a slider which will later be described.

Figure 6:
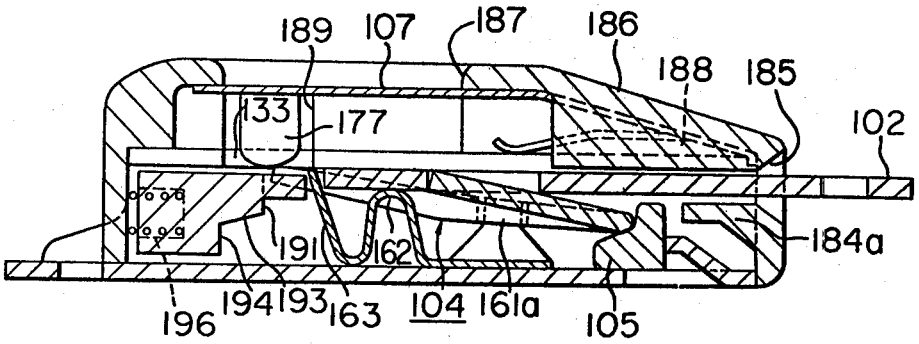
FIG. 6 is a longitudinal cross-section of the same embodiment taken along the center line thereof and showing the position in which the tongue is locked.

The slider 109 is installed adjacent to that end of the base bottom plate 130 which is formed with the slot 131, and biased in the tongue withdrawal direction by the two cylindrical coil springs 100 and 110. This slider has a protrusion near the center of the right end thereof, and the end face 195 of that protrusion is always in contact with the second spring piece 163 of the plate spring 106. Further, the slider 109 has stepped portions formed by right vertical end surfaces 191, 192 adapted for contact with the end faces of the horned portions 143 and 144 of the latch member during the locking of the tongue by the latch member, a lower vertical end surface 194 adapted for contact with the end faces of the horned portions 143 and 144 when the latch member 104 is maintained in its non-locking position, and a substantially horizontal intermediate surface 193 extending between the right vertical end surfaces 191, 192 and the lower vertical end surfaces 194. Preferably, the left end face of the slider may be provided with recesses 196 (only one of which is seen in FIG. 6) for receiving the springs 100 and 110. The cylindrical coil springs 100 and 110 are horizontally positioned with their right end portions received in the recesses 196 and their left ends engaged with the inner surface of the left end wall of the cover so as to bias the slider 109 in the tongue withdrawal direction.

In the present embodiment, the width of the slider 109 is smaller than the dimension between the ears 176 and 177 of the push button 7 so as to permit rotating movement of these ears along the outer side of the slider, but alternatively, the width of the slider 109 may be made greater than the dimension between the ears 176 and 177 and slits (not shown) for passing the ears therethrough may be formed in the opposite side edges of the slider.

The tongue 102 comprises a portion 121 to be inserted into latch device 10 through the slot 185 of the buckle cover 108, and a portion 122 for the connection of webbing 9. The insertable portion 121 of the tongue 102 is formed with a locking hole 121*a* engageable with the projection 142 of the latch member 104 to prevent withdrawal of the tongue, and the webbing connection portion 122 is formed with a slot 122*a* for the connection of the webbing.

With the above-described connection, the latch member 104 of the latch device 10 is in the position of FIG. 6 while being upwardly biased by the plate spring 106.

Now, in FIG. 6, when the push button 107 is depressed, the latch member 104 is depressed by the horned portions 143 and 144 thereof being engaged with the ears 176 and 177 of the push button and the end faces of the horned portions 143 and 144 are disengaged from the vertical end surfaces 191 and 192 of the slider 109 while, at the same time, the slider is slid in the tongue withdrawal direction by the actions of the springs 110 and 111, whereby the latch member 104 is held down in its non-locking position by the intermediate surface 193 of the slider 109 (FIG. 7) and the tongue is caused to jump out in its withdrawal direction by the force of such sliding movement of the slider and by the force of the second spring piece 163 of the plate spring 104.

Figure 7:
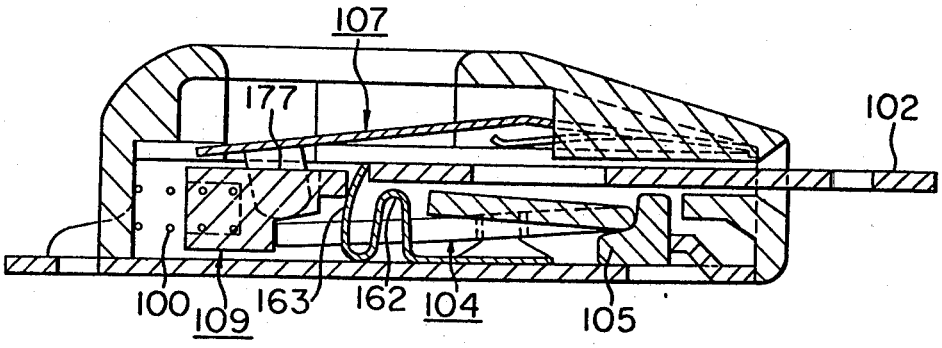
FIG. 7 is a view similar to FIG. 6 but showing the position in which the tongue is unlocked by operation of the push button.

Next, when the tongue 102 is inserted into the buckle device 10 through the slot 185 in the manner as shown in FIG. 7, the inner end of the tongue cooperates with the upper portion of the second spring piece 163 of the plate spring 104 to displace the slider 109 leftwardly against the bias of the springs 100 and 110. When this occurs, the upper surfaces of the ends of the horned portions 143 and 144 of the latch member 104 come out of engagement with the horizontal intermediate surface 193 of the slider 109 and simultaneously therewith, the latch member 104 upwardly biased by the plate spring 106 is pivotally moved clockwise so that the latch member 104 comes into its locking position with respect to the tongue 102. At this time, the inner end of the tongue 102 is in engagement with the second spring piece 163 of the plate spring 106 to urge this spring piece into its biased position.

Figure 9:
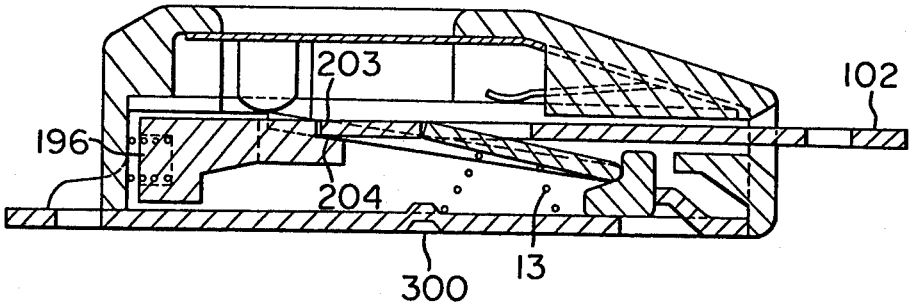
FIG. 9 is a longitudinal cross-section of a third embodiment taken along the center line thereof and showing the position in which the tongue is locked.
Figure 10:
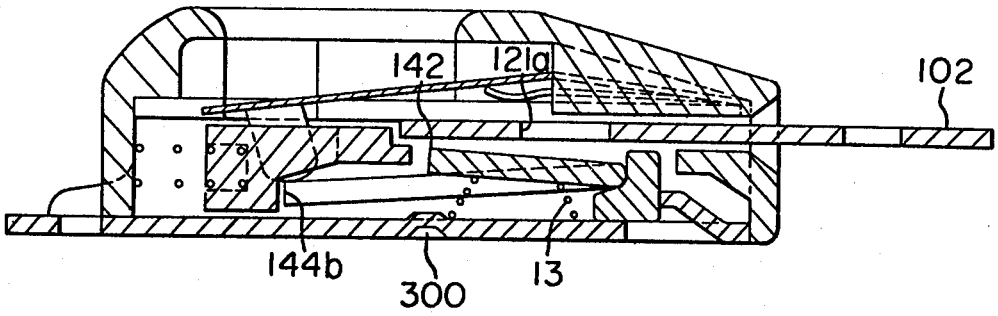
FIG. 10 is a view similar to FIG. 9 but showing the position in which the tongue is unlocked by operation of the push button.
Figure 11:
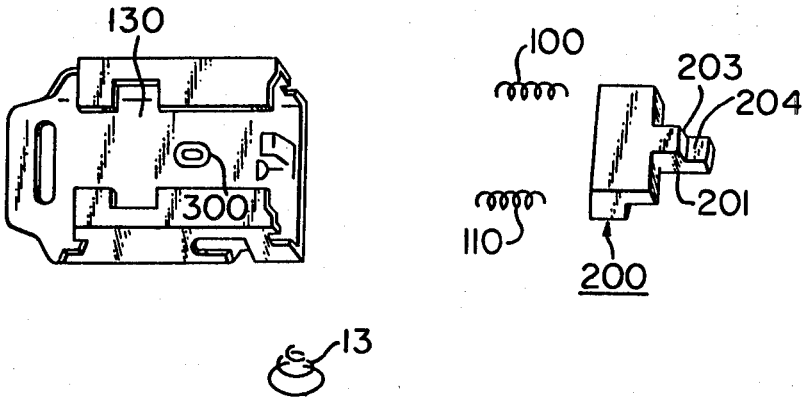
FIG. 11 is a perspective view of a part of the same embodiment.

Description will now be made of a third embodiment of the present invention as shown in FIGS. 9 to 11.

In the third embodiment, as compared with the above-described second embodiment, the plate spring 106 is replaced by a conical coil spring 13 and correspondingly, a circular boss 300 is provided substantially centrally of the base bottom plate 130, and the slider 109 shown in FIG. 8 is replaced by a slider 200 as shown in FIG. 11.

The conical coil spring 13, lying below the upwardly extending projection 142 of the latch member 104, rests on the base bottom plate 130 so as to biasingly support the latch member, and is immovably fixed in position by the circular boss 300. The slider 200, as compared with the configuration of the slider 109, further has a second stepped portion on the upper part of the end of the projected portion 201 located near the center of the right end. The horizontal surface 204 of this second stepped portion 201 performs a function similar to that of the bent portion 162 of the plate spring 106 in the second embodiment. More specifically, the horizontal surface 204 supports the tongue when unlocked from the latch member, thereby preventing the tongue from lowering (see FIG. 10). Also, the vertical surface 203 of the second stepped portion 201 is in abuttment with the inner end of the tongue when locked, so that when the tongue is unlocked, the vertical surface 203 causes the tongue to jump out in its withdrawal direction with the aid of the bias of the springs 100 and 110 and when the tongue is inserted, the vertical surface 203 serves as a means for receiving the force from the tongue to displace the slider 200 leftwardly.

The operation of the third embodiment will be readily apparent from FIGS. 9 and 10.

While the present invention has been described with respect to its preferred embodiments, it should be noted that various changes and modifications may be made in the present invention without departing from the spirit and principle thereof as defined in the appended claims.

What we claim is:

1. A latch device in a seat belt buckle, comprising: a load member, means supported on said load member for latching a tongue, means for biasing said latching means toward a tongue locking position, releasing means adapted, when operated, to bring the latching means into a tongue unlocking position, and false latching preventing means having selectively a first position where said latching means is held thereby in the tongue unlocking position and a second position where said latching means is freed therefrom, said preventing means being biased toward the first position and engages the tongue when the tongue is inserted, whereby when the tongue is inserted to displace the preventing means from the first position to the second position, the latching means latches the tongue, the preventing means is held in said second position by the latched tongue, and when the releasing means is operated to bring said latching means into the tongue unlocking position to free the tongue, the preventing means is brought from said second position to said first position.

2. A latch device according to claim 1, wherein said false latching preventing means is a slider biased toward said first position.

3. A latch device according to claim 2, wherein said slider has a first surface which is engageable with said latch member when in its locking position, whereby said slider is maintained in said second position.

4. A latch device according to claim 3, wherein said slider has a second surface which holds said latch member in its unlocking position when said slider is in said first position.

5. A latch device according to claim 4, wherein said slider has a third portion for releasing said latch member held in its unlocking position by said slider in said first position.

6. A latch device according to claim 5, wherein said third portion is a third surface which is engageable with said tongue when inserted, whereby said slider is brought from said first position to said second position.

7. A latch device according to claim 6, wherein said third surface forces out said tongue when said slider slides from said second position to said first position.

8. A latch device according to claim 7, wherein said slider has a fourth portion for maintaining said tongue horizontal.

9. A latch device according to claim 8, wherein said bias means for biasing said latch member to its tongue locking position is a conical coil spring.

10. A latch device according to claim 8, wherein said bias means for biasing said latch member to its tongue locking position is a conical coil spring.

* * * * *

UNITED STATES PATENT AND TRADEMARK OFFICE

CERTIFICATE OF CORRECTION

PATENT NO. : 4,232,433

DATED : November 11, 1980

INVENTOR(S) : Takeo UEDA et al

It is certified that error appears in the above-identified patent and that said Letters Patent are hereby corrected as shown below:

On the title page, in the left column after the line which reads: "[62] Division of Ser. No. 811,386, Jun. 29, 1977." insert the following lines:

__[30] Foreign Application Priority Data

Jun. 30, 1976 [JP] Japan ..... 51-85082[U]

Feb. 14, 1977 [JP] Japan ..... 52-15724[U]__.

Signed and Sealed this

Seventeenth Day of February, 1987

*Attest:*

DONALD J. QUIGG

*Attesting Officer*

*Commissioner of Patents and Trademarks*